United States Patent [19]

Johnson

[11] 4,089,388

[45] May 16, 1978

[54] FLUID CONTROL SYSTEM

[75] Inventor: Leonard L. Johnson, Fort Wayne, Ind.

[73] Assignee: Teco, Inc., Fort Wayne, Ind.

[21] Appl. No.: 720,569

[22] Filed: Sep. 7, 1976

[51] Int. Cl.[2] ..... B66F 11/04

[52] U.S. Cl. ..... 182/2

[58] Field of Search ..... 182/2, 148, 141; 137/625.69; 212/17, 8 R, 35 R, 54, 144

[56] References Cited

U.S. PATENT DOCUMENTS

| | | | |
|---|---|---|---|
| 3,082,842 | 3/1963 | Balogh | 182/2 |
| 3,106,135 | 10/1963 | McAfee | 137/625.69 |
| 3,160,174 | 12/1964 | Schmiel | 137/625.69 |
| 3,812,883 | 5/1974 | Yokokawa | 137/625.69 |
| 4,011,891 | 3/1977 | Knutson | 137/625.69 |

*Primary Examiner*—Reinaldo P. Machado
*Attorney, Agent, or Firm*—John A. Young

[57] ABSTRACT

A hydraulic valve system uses spool type pilot valves with the valve openings notched to provide non-linear response to movement of pilot valves. A servo type valve with a four-way spring centered spool is operated either manually or hydraulically by the spool pilot valve. A limit stop is located at each end of the servo spool valve. The notching geometry in the spools of both the pilot valve and servo valve provide a non-linear response such that controllability and safety are improved, without hysteresis.

The system has a manual override on both ends of the servo valve which is operated independently of the pilot spool valve.

The system is proposed for use on articulated aerial towers which consist of a mobile platform, a rotatable mounting for a lower boom, an upper boom having an articulated mounting on the lower boom, and personnel or tool carrying basket at the outer end of the upper boom.

10 Claims, 17 Drawing Figures

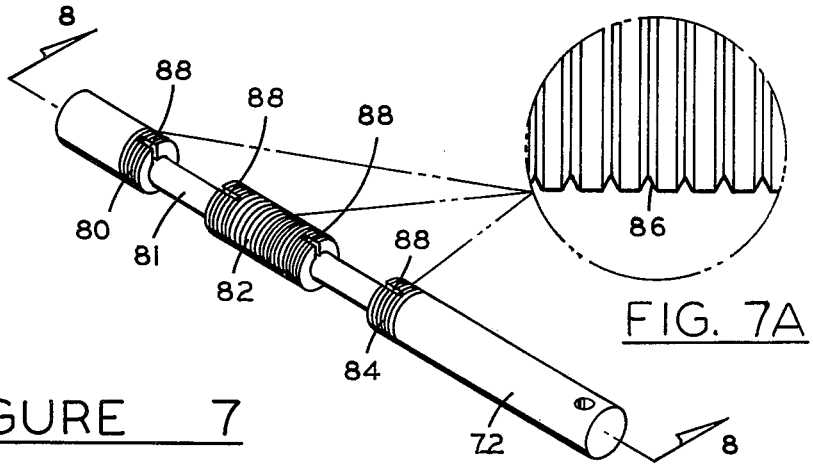
FIG. 7A
FIGURE 7
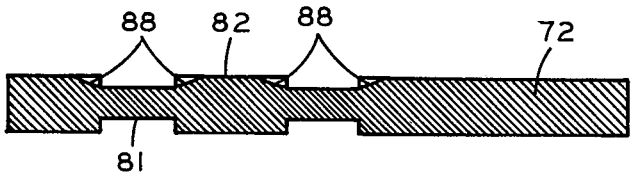
FIGURE 8
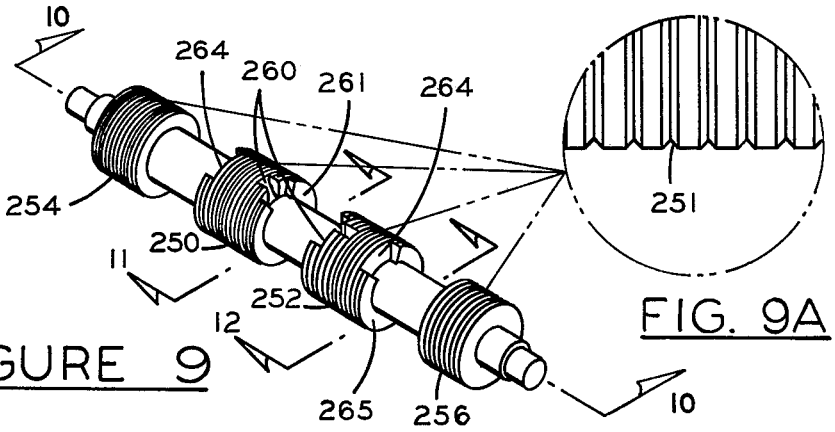
FIG. 9A
FIGURE 9
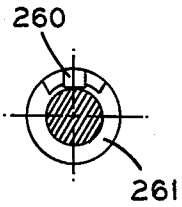
FIG. 11
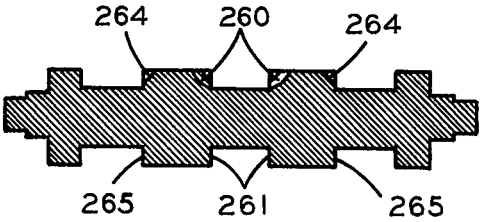
FIGURE 10
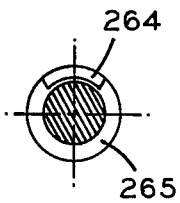
FIG. 12

FLUID CONTROL SYSTEM

BACKGROUND OF THE INVENTION

Self propelled articulated boom aerial towers have gained considerable acceptance and popularity in the art in such applications as servicing and constructing electrical power lines, telephone lines, street light maintenance, etc. Experience has proven that many shortcomings exist in the control systems for these so-called "cherry-pickers".

The individual in the basket, at the end of the articulated upper boom, must have available a set of hydraulic controls which are intended to place the basket and occupant at a precise location in relation to the work performed. Since the item worked upon is a potentially dangerous power transmission line or the like, it is necessary to provide the operator with a precise, dependable control system. The control system should be, and is intended to be, capable of positioning the basket, and the occupant, in any one of three dimensions, i.e. vertically, horizontally and laterally. The difficulty with many of these controls has been the tendency to cause lurching, particularly at start-up and stop of the basket in any given direction responsively to actuation of the controls by the operator. The controls now available and in current use on "cherry-pickers", are generally deficient in that they do not provide for "feathering" or a fine control whereby the operator can gradually, and with a sure touch, bring the basket to whatever position is desired and avoid lurching or vibrating the basket as it moves from one position to the next by periodically stopping and starting.

It has been further found, that a "cherry-picker" must have as a safety precaution to the occupant in the basket, a ground level means for returning the basket through controls which are located at ground level so that in the event the basket occupant controls are either inoperative or the occupant is unable to operate the controls for one reason or another, the basket can be safely returned to ground level entirely by controls at the ground level.

Therefore, a dual control system is required in which there are two control systems; one in the basket accessible to the operator therein, and a second control system at ground level and available to a second operator; both such control systems being independently operable to effect energization of means for moving the basket in its vertical, horizontal, and lateral movements.

It is particularly important that the ground control system can in no way hamper the control system in the basket. Similarly, the control system in the basket should not be dependent upon movement of the ground control. Thus, neither control system interferes with the other in its normal independent operation.

One problem of control systems in general is known as "hysteresis", a condition in which a system continues to operate even after the demand for such movement is terminated. A characteristic of the present invention is that the system not only admits "feathering", i.e. fine control, but is completely free of hysteresis or unintended movements of the basket.

OBJECTS OF THE INVENTION

It is a principal object of the present invention to provide an improved hydraulic control system in which, by means of a uniquely configured spool valve, it is possible to produce a non-linear response in the operation of a basket forming a part of a "cherry-picker."

Another object of the present invention is to provide a unique a closed center hydraulic control system in which the hydraulic response is calculated, through a uniquely configured valve system, to achieve a "feathering" in which the operator can precisely locate a basket by operation of a control system. In the process of operating I avoid objectionable and unnecessary vibrations owing to too sudden stopping and starting of the basket.

Another important object of the present invention is to produce a unique control system in which, at neutral positions of the control lever, the control system response is characterized by non-linearity requiring substantial lever movement to produce a given basket movement; hence more precise control is obtainable. But at extremes of control lever position, conditions more closely approximating linearity and higher basket operation speeds are obtained because slight lever movements produce substantial speed and degree of basket movement. Therefore, the system incorporates the advantages of a non-linear response at, or approximately at, neutral position of the valve. Such characteristics are designed however to approach linearity at the extreme ends of the control lever positions thus incorporating a combination of speed and accuracy in control in the normal functions of operation of the control at the basket level by the operator. Obviously, one of the correlative advantages of the invention is that relatively unskilled workers can readily adapt to operating conditions of the basket causing the basket to be easily and accurately positioned even without extensive experience with the operating mechanism.

Another object of the invention is to provide dual control systems each independently operable and without interfering with the other, the one controlled by the operator in the basket, and the other at ground level in the event the basket control is inoperable or the accupant is disabled. A unique feature of this dual independent control system is that both incorporate the unique configuration of dual spool valves enabling "feathering" for fine control and high speed control at extreme positions of the control levers.

Other objects and features of the present invention will become apparent from a consideration of the following description which proceeds with reference to the accompanying drawings in which a selected example embodiment is illustrated by way of example and not by way of limitation of the invention.

DESCRIPTION OF THE DRAWINGS

FIG. 7 illustrates the pilot spool valve shown removed from the associated hydraulic construction, and in enlarged detail isometric view;

FIG. 7A is an enlarged detail view showing the grooves which are regularly formed in the spaced lands of the spool valve of FIG. 7;

FIG. 8 is a sectional view taken on line 8—8 of FIG. 7;

FIG. 9 is an isometric view of a spool valve shown detached from the associated hydraulic mechanism and constituting part of the servo valve at the base of the unit;

FIG. 9A is an enlarged detail view illustrating the grooved configuration of the lands of the spool valve of FIG. 9;

FIG. 10 is a sectional view taken on line 10—10 of FIG. 9;

FIGS. 11 and 12 are sectional views taken on lines 11—11 and 12—12 respectively of FIG. 9; FIG. 15 illustrates Cylinder Velocity, % of Maximum Velocity v. Pilot Valve Stroke % Full Open.

DETAILED DESCRIPTION OF THE INVENTION

Figure 1:
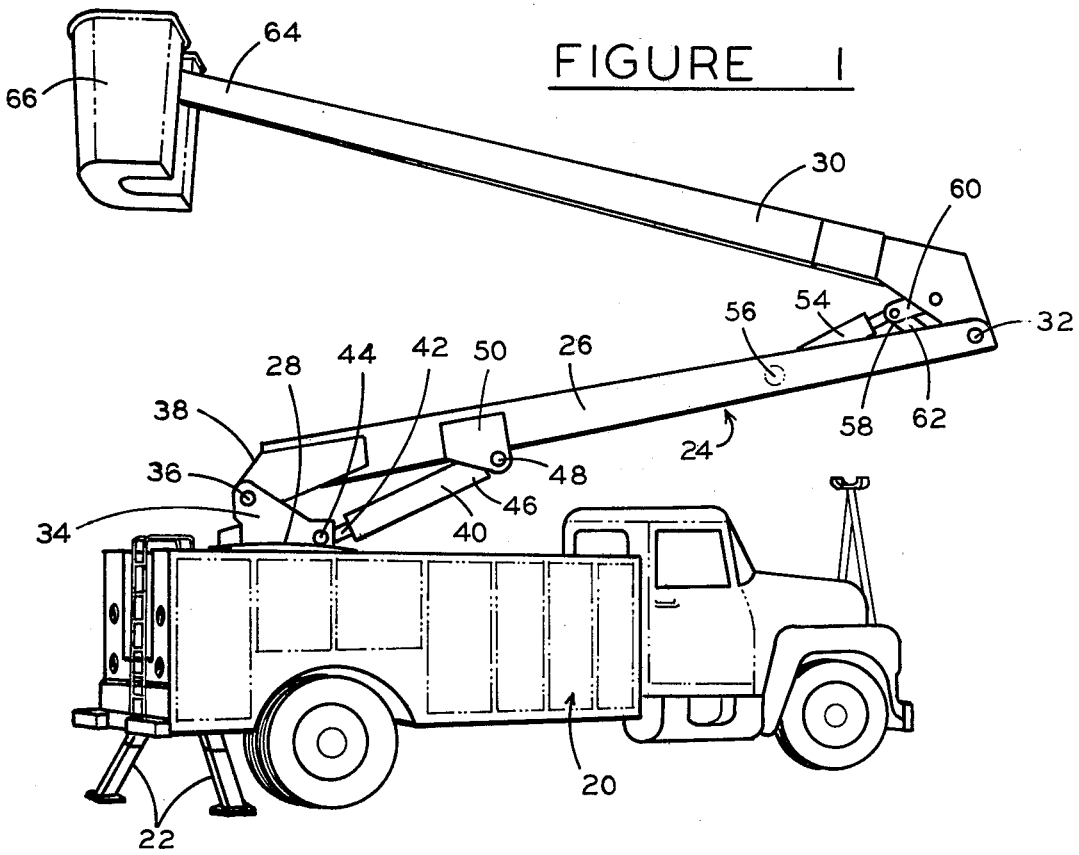
FIG. 1 is a perspective detail view showing a mobile aerial tower partly elevated.

A vehicle or truck designated generally by reference numeral 20 includes two outrigger supports 22 which are extended into ground engagement during use of an articulated aerial tower designated generally by reference numeral 24 and including a lower boom 26 mounted on a turntable 28 and an upper boom 30 having an articulated connection with lower boom 26 at pivot mounting 32.

Turntable 28 includes two spaced stanchions 34, and an axle 36 extending therebetween, forming the pivot support for lower end 38 of boom 26. Boom 26 is rotated about 36 by a power cylinder 40 having a piston rod 42 connected to pivot 44 of stanchion 34, and cylinder 46 pivotally secured to pivot pin 48 secured by gusset plates 50 to lower boom 26. The upper boom 30 is pivoted about pivot mounting 32 by means of a second power cylinder 54 pivotally secured at 56 to lower boom 26 and acts through linkage 58 including 4-bar linkage members 60 and 62 to pivot upper boom 30 about 32. For further details of the linkage reference may be made to Bruce E. Dammeyer's application No. 603,789 filed Aug. 11, 1975 now issued as U.S. Pat. No. 4,047,593 dated Sept. 13, 1977 and assigned to the same assignee as the present application.

A hydraulic motor (not shown) is used for effecting turning of turntable 28 about a base in bed 62 of the truck. Details of the mounting of the turntable and motor actuator are not part of the present invention.

At end 64 of upper boom 30, there is suspended a fiber reinforced plastic basket 66 which includes a levelling mechanism (not shown) whereby the basket 66 is maintained perpendicular to the ground regardless of the angular position of upper boom 30 about pivot 32.

Figure 4:
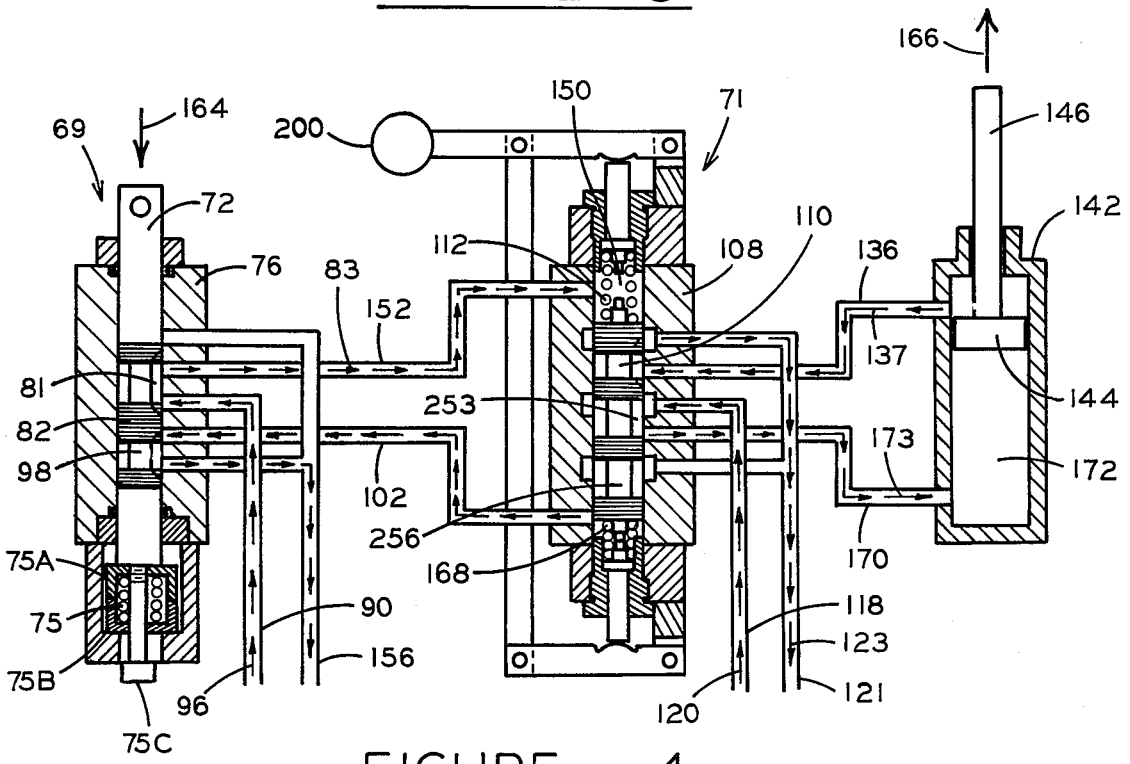
FIG. 4 illustrates the same hydraulic mechanism illustrated in FIG. 2 in an operation opposite that of FIG. 3.
Figure 5:
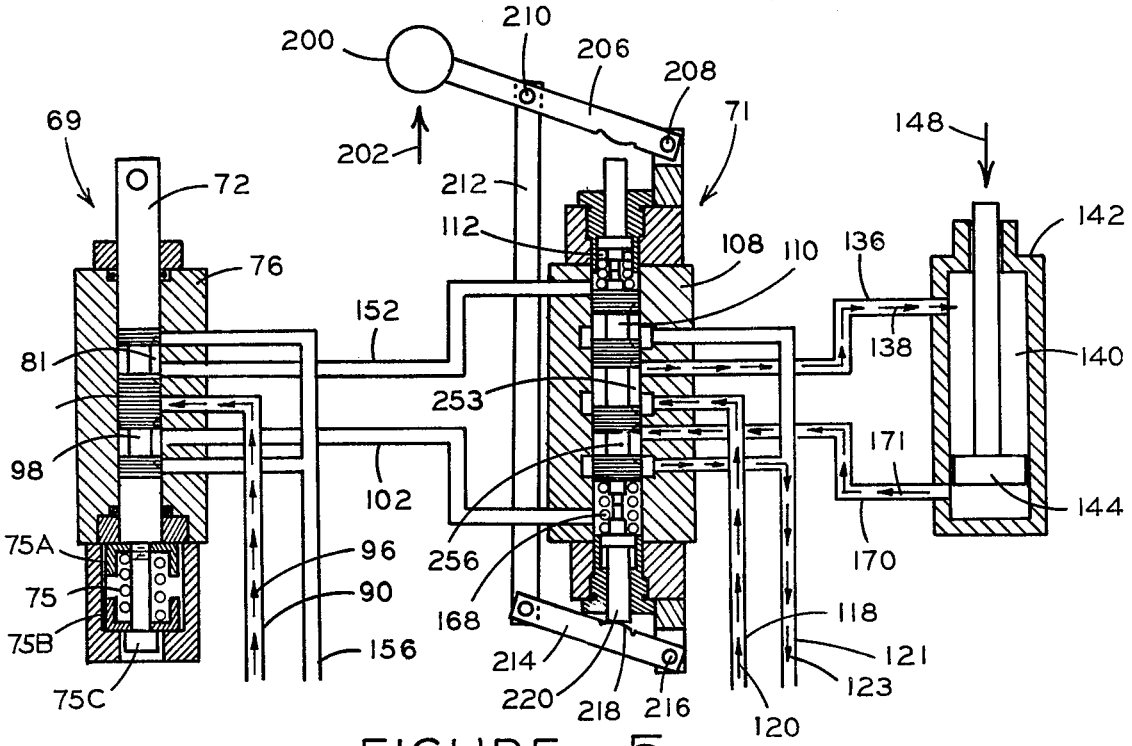
FIG. 5 illustrates the operation of the servo valve at the base level in a mode of operation the same as effected by the pilot valve in FIG. 3.
Figure 6:
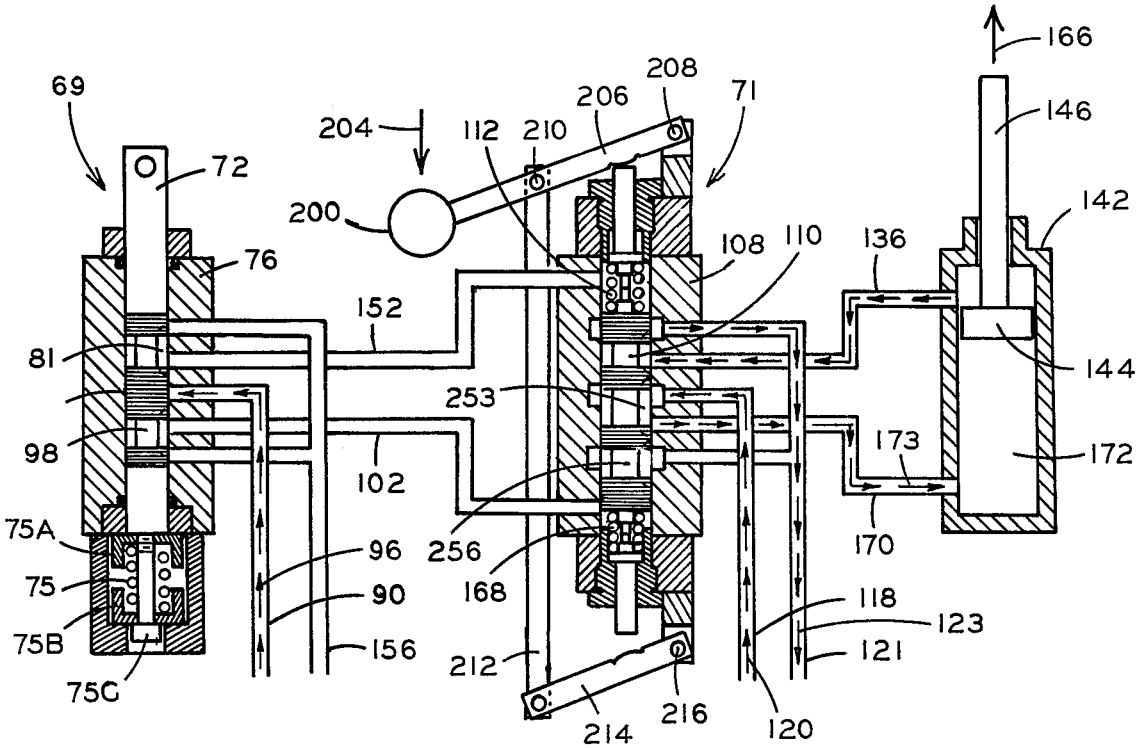
FIG. 6 is the same as FIG. 5 but with the servo valve moved in a direction effecting an opposite operation from that of FIG. 5, and the same mode as produced by the pilot valve in FIG. 4.

A handle or control mechanism is disposed in the basket and has three modes of operation such that moving the handle up and down operates power cylinder 54; moving the handle horizontally, that is parallel to the ground, operates power cylinder 40; and twisting the handle effects rotation of the turntable 28. By a combination of these lever movements it is possible to dispose the basket 66 in any preferred position. Each of the power devices, 54, 40, and that associated with the turntable 28 has a hydraulic control mechanism indicated in FIGS. 2–4 associated with the control mechanism of the basket. Each power device is operated by a pilot valve portion of the system and also by a servo valve, each being independently operative of the same power devices 54, 40 and that associated with the turntable 28 so that the basket is positionable by the pilot valve 69 which is part of the control mechanism in the basket 66 and is directly operated by the operator within the basket 66; or, each power device is operable by the servo valve 71, at ground level, independently of the pilot valve 69 (FIGS. 5, 6). Assuming that the operator wishes to ascend vertically, the operator in the basket raises the control handle thus effecting operation of the control mechanism illustrated in FIGS. 2, 3 and 4 and power cylinder 54. The hydraulic construction which is operated from the basket 66 will next be described in detail with particular reference to FIGS. 3–5. Upward movement of the control handle (not shown) effects upward movement in the direction of the arrow 70, of spool valve 72 within cylinder bore 74 of valve housing 76. Spool valve 72 has lands 80, 82, and 84 each with a plurality of V-shaped cross-section grooves 86 (FIGS. 7, 7*a*). In addition to the grooves 86, there is an arcuate notch 88 (FIG. 8) which is formed in the groves of lands 80, 82, 84 of spool valve 72. Thus, when the spool valve 72 is moved upwardly in the direction of the arrow 70 from its position shown in FIG. 2, inlet line 90, terminating in inlet port 92, is uncovered by land 82. The arcuate notch 88 provides initially a small cross-section and for successively greater movements in the direction of the arrow 70 an increasingly larger area is provided whereby fluid can flow in the direction of the arrows 96 past the small diameter section 98 of spool valve 72 through port 100 of line 102 as indicated by the arrows 104 and into chamber 106 of valve housing 108 where a second spool 110 is displaced against resistance of spring 112 and thereby displacing the spool valve sufficiently to permit hydraulic fluid from inlet line 118 to flow in the direction of the arrow 120 through port 114 formed by groove 116 and 132 which is uncovered by land 134 and enter line 136. Fluid moves in the direction of the arrows indicated by 138 into chamber 140 of power cylinder 142 and displaces the piston 144 and piston rod 146 in the direction indicated by arrow 148. When spool valve 72 moves upwardly in the direction indicated in FIG. 3, chamber 150 exhausts fluid through line 152, such exhausting fluid flowing in direction of arrows 153 past notch 88 in land 82 and notch 88 of land 80 (FIGS. 7, 8) in chamber 154 to exhaust through line 156. The fluid flow within line 156 is in the direction indicated by the arrows 160 as it exhausts to reservoir (not shown).

Figure 2:
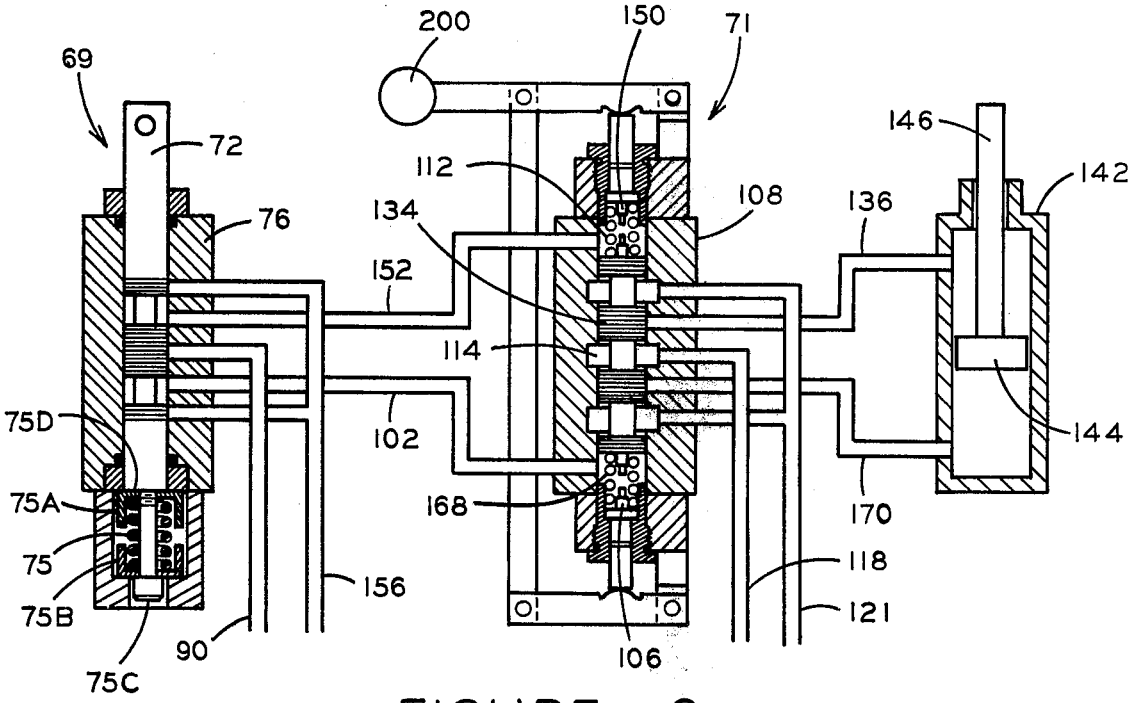
FIG. 2 is a sectional schematic detail view of the hydraulic control pilot valve associated with the basket, the associated servo valve located at the base, and the power cylinder, all of which are located in neutral position.
Figure 3:
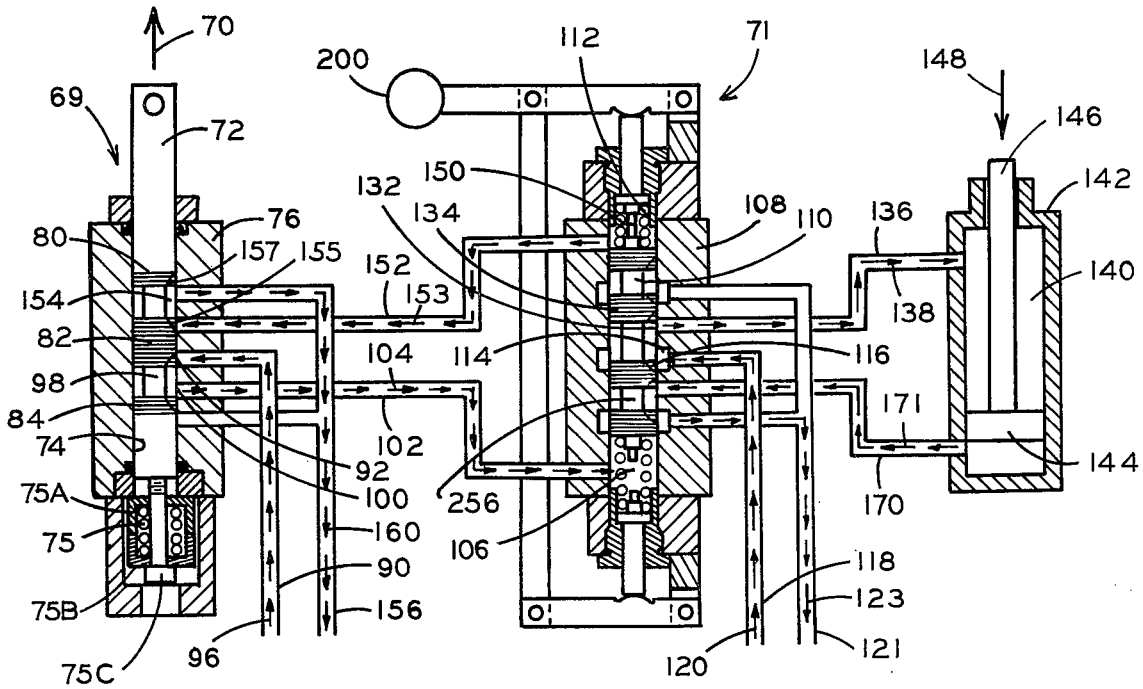
FIG. 3 illustrates the hydraulic mechanism of FIG. 2 in which the pilot valve is operated in one direction to effect actuation of the associated power cylinder in one mode of operation.

When the spool valve 72 is moved downwardly in the direction indicated by arrow 164 (FIG. 4) piston 144 is raised moving in the direction of the arrow 166. As the spool valve 72 is moved downwardly as indicated in FIG. 4, fluid pressure from inlet line 90 is transmitted past the arcuate notch section 88 and grooves 86 of land 82, chamber 81, grooves 157 of land 80 and moves in the direction of arrows 83 in line 152, thence to chamber 150 causing the spool valve 110 to move downwardly against the resistance of spring 168 and communicating line 118 with line 179 to transmit hydraulic pressure from line 118 through line 170 to chamber 172 of cylinder 142, thereby raising the piston 144 and piston rod 146. Consequently, the operating handle within basket 66 will operate the power cylinder 54 (FIG. 1) in one or the other of opposite directions and acting through power piston 144 and piston rod 146, pivots the upper boom 30 about 32 to effect raising or lowering movements of the basket 66. Identical but different hydraulic controls described in FIGS. 2–4 are associated one with power cylinder 54, one with power cylinder 40, and one with the power motor (not shown) for turntable 28. Thus, movements of the control handle in either up of down, back and forth (parallel to the ground), and twisting the handle about the wrist causes the basket to move arcuately in vertical, horizontal, and lateral senses respectively. Movements can also be effected by combining the operations of power cylinders 40, 54, and the power cylinder associated with the turntable 28. Thus, basket 66 can be swung upwardly by 54, and counterrotated upwardly by 40. The two movements are thus coordinated so that basket 66 is moved vertically, straight up by rotating the lower boom 26 counterclockwise about 36 and rotating upper boom 30 clockwise about 32. The basket can also be moved in a straight horizontal sense by rotating boom 30 counterclockwise together with clockwise or counterclockwise movement of the lower boom by power cylinder 40.

When it is desired to move the basket 66 laterally or arcuately, the operating handle is twisted. This operates a fluid motor actuator the same as described in FIGS. 2–4 thereby effecting rotation or counterrotation of the turntable 28 about and the attached grooves 28, 30 a vertical axis.

Operation of the control mechanism in the basket has no effect whatever on the position of the ground handle 200 which is capable of performing the same operations independently of the controls in the basket, this being accomplished in the manner next to be described in connection with FIGS. 5 and 6.

When it is desired to duplicate the same movements but independently of the pilot valve 69, the servo valve 71 at ground level can produce the identical basket movements. The handle 200 is moved either upwardly in the direction of the arrow 202, FIG. 5 or moved downwardly in the direction of the arrow 204 in FIG. 6. When the handle 200 is moved upwardly as indicated in FIG. 5, the link 206 is moved clockwise about 208 and through connection 210 drag link 212 is moved upwardly. As drag link 212 is moved upwardly, it pivots link 214 about 216 engaging surface 218 with end 220 of spool valve 110 and effecting the same fluid connections which effect fluid pressure buildup within chamber 140 as described in FIG. 3. That is, fluid in line 118 moves in the direction of the arrows 120 and is communicated through line 136 in the direction of arrows 138 to chamber 140 causing the piston 144 to move downwardly in the direction of the arrow 148. The only difference in this case is that the fluid connections are provided by mechanical displacement of spool valve 110 of servo valve 71 through handle 200, such action occurring mechanically rather than hydraulically by means of the pilot valve 69, and is effected entirely independently of the pilot valve 69.

To obtain opposite movement of the power piston 144, the handle 200 is moved downwardly in the direction of the arrows 204 effecting the same hydraulic connections as described in FIG. 4, except that the pilot valve 69 again remains stationary, but the total effect is to communicate hydraulic pressure and fluid flow in the direction of arrows 120 in line 118, such fluid pressure then being transmitted through line 170 to chamber 172 and effecting a lifting action on the piston rod 146 in the direction of arrow 166. The result is the same as achieved by pilot valve 69 (FIG. 4).

The pilot valve is maintained in a neutral centered position by a spring 75 which is compressed between two spring cages 75A and 75B so that in the center position, the spool valve 72 of the pilot valve 69 is maintained in the position shown in FIG. 2. When the spool valve is drawn upwardly an enlarged head 75C acts against cage 75B and the spool valve can be moved until the two cages are brought into engagement, one with the other FIG. 3. Likewise, when the spool valve is moved in the opposite direction, as shown in FIG. 4, the the spring 75 is compressed until the spring cages of 75A and 75B are brought together.

Still referring to FIGS. 3 and 4, when the power piston is moved downwardly in the direction of arrow 148, fluid is exhausted through line 170 in the direction of the arrow 171 and passes through the servo valve 71 through exhaust line 121 in the direction of the arrows 123.

Referring to FIG. 4, when the power piston is moved upwardly in the direction of the arrow 166, fluid exhausts through line 136 in the direction of the arrows 137 through servo valve 71 to line 121 exhausting in the direction of the arrows 123 the same as in FIG. 3.

There is a ground level set of controls and control handles 200, one for each of the power cylinders 40, 54 and the power motor associated with the turntable 28 so that composite movements of the basket can be produced by the three handles one operating each of the power cylinders associated with vertical, horizontal and arcuate (transverse) movements obtained of the basket 66.

OPERATION OF THE DEVICE

In operation, the vehicle 20 is driven to the site where the work is to be performed and outriggers 22 are extended to provide lateral stability for the vehicle preventing tipping from overhang which occurs when the basket 66 is maneuvered from one side of the truck to the other.

The operator (or operators) then enters the basket 66 from the bed of the truck and, by using controls for moving the pilot valve 69, effects operation of one or a combination of the power cylinders 40, 54 and the power motor associated with turntable 28 thereby positioning the occupants. Each of the cylinders 40, 54, and the one associated with turntable 28 is identically operated from the basket by the hydraulically actuated system shown in FIGS. 2, 3, and 4; only one of which will be described in association with power cylinder 54, but it being understood that there is an identically operatable actuating system one for each of the power devices effecting vertical, horizontal and lateral movements respectively, of the basket. Assuming that the occupants wish to go vertically upward, the boom 30 is pivoted clockwise about 32 by the power cylinder 54, this being effected by moving spool valve 72 downwardly in the direction indicated by arrows 164 in FIG. 4 and displacing the land 82 so as to uncover a port 92 (FIG. 4) permitting fluid to flow in the direction indicated by arrows 96 in line 90 past the arcuate notch 88 (FIG. 8) and grooves 86 (FIG. *7a*) of land 82. Fluid then flows within the space provided between the cylinder bore 74 and the reduced diameter section 81, such fluid then passing in the direction indicated by arrows 83 in line 52 and entering chamber 87 which depresses the spool valve 110 downwardly against the resistance of spring 168.

The described displacement of spool valve 110 enables hydraulic pressure and fluid flow in the direction indicated by arrows 120 in line 118 past land 250 and its notch 260 (FIG. 9) space 253 between cylinder bore 255 and reduced diameter portion 257, notch 261 of land 252, through line 170 to chamber 172 displacing piston 144 and piston rod 146 in the direction indicated by the arrow 166 (FIG. 4).

The described actuation by pilot valve 69 of servo valve 71 and power cylinder 142 operates power cylinder 54 and arcuate movement of the upper boom 30 causes lifting of the basket 66 in a clockwise movement about 32 (FIG. 1) because of the basket moving in an arc. The basket during this period is held in a level position by a levelling (not shown) and which is not part of the present invention. There is a slight forward movement of the basket which accompanies the arcuate movement and if it is desired to maintain a straight perpendicular upward movement, the power cylinder 40 is concurrently operated by the same actuator mechanism counterrotating the lower boom 26 counterclockwise about 36 and a composite of both boom movements effects straight vertically upward movement of the basket 66.

Figure 13:
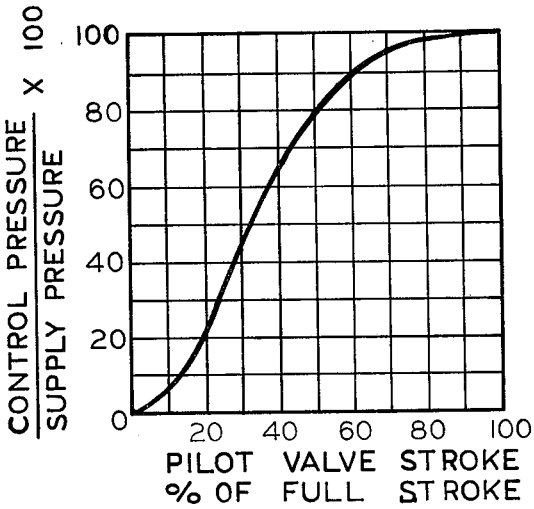
FIGS. 13, 14, and 15 illustrate characteristics of operation of the valve, FIG. 13 representing the ratio of Control Pressure to Supply Pressure v. Pilot Valve Stroke, FIG. 14 representing Valve Area in Percent of Full Open Position v. Servo Valve Spool Stroke In Percent of Full Stroke.
Figure 14:
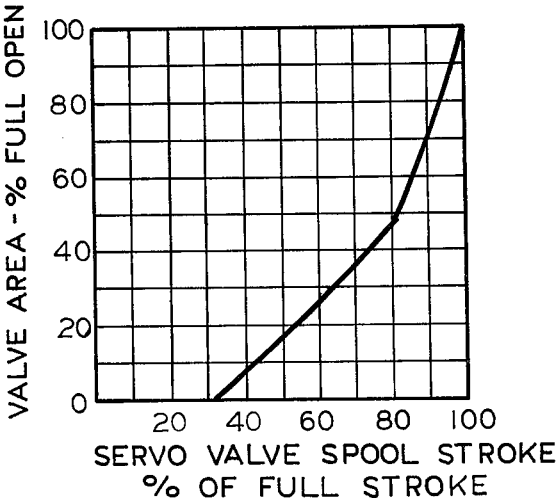
Figure 15:
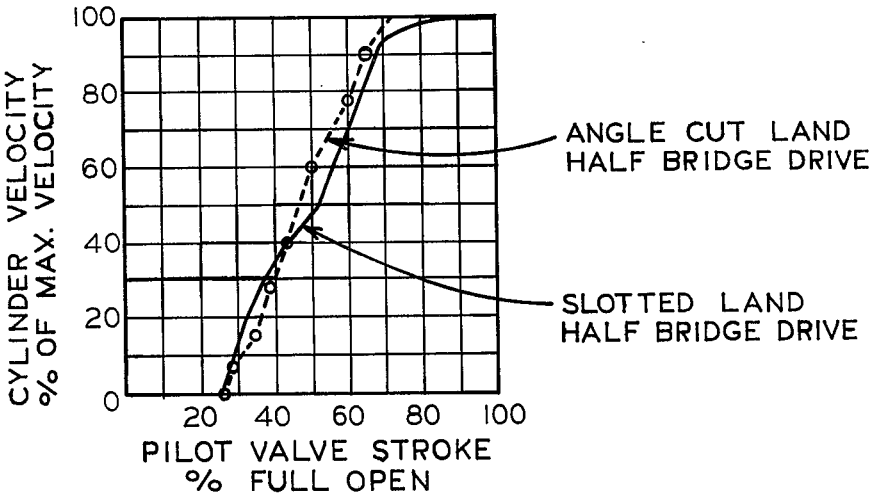

One of the important characteristics of the present invention, is that when the control mechanism first initiates operation of one or the other of the power cylinders it does so in conformity with the hydraulic characteristics shown in FIGS. 13, 14, and 15. From these curves, it will be seen that when the pilot valve 69 or the servo valve 71 first moves from its neutral position, there is a relatively greater amount of spool valve stroke required to effect a change in ratio of control pressure to supply pressure. In practical terms, this means that there is a non-linear response which in effect desensitizes the control system for the first increments of movement of the control and the control becomes, thereafter, more sensitive, i.e., more linear. What this accomplishes, is a more gradual response of the power cylinder associated with the boom, to movement of the control handle from its original central position so that startup and stopping commences and ends by a "feathering" action as compared with movement of the pilot valve at its end positions where the response is more linear and the speed of response is also greater. How this works out in operation, is that the operator starts the basket 66 out gradually then speeds up its vertical, horizontal and arcuate movements until coming into close approximation with the site of work. The operator then feathers the final approach by producing basket movements in the non-linear range of control produced by the pilot valve. The operator uses a combination of high speed "linear" type response characteristics by pushing the controls toward the extreme positions when speed is called for and low speed non-linear feathering approach is used for the final or critical adjustments of basket position utilizing that part of the pilot valve stroke indicated in FIGS. 13 and 15 in which the pilot valve is "feathered" and produces smaller basket velocity per degree of control valve movement achieved with the valve at its initiated movements from neutral.

Since it is necessary for the operator to approach some work sites with considerable caution and precision, there is available to the operator a control mechanism which incorporates both high speed movement of the basket where positioning is non-critical and then a much lower speed with a non-linear type response and control when the basket approaches its final position by "feathering" movements.

Should the operator be unable to maneuver the basket from the upper basket level because of some malfunctioning of the control, or for any other reason, the basket can be equally maneuvered by a ground control utilizing servo spool valve 110 through associated control 200 and control lever 206. In this case, the linkage 206, 212, 214 is used to mechanically displace servo valve 71. Such movement as indicated in FIG. 5, effects displacement of the spool valve 110 upwardly producing hydraulic connections via line 118 through the valve to line 136, the hydraulic flow being in the direction of the arrows 138 and displacing power piston 144 in the direction of the arrow 148. Movement of the handle 200 the opposite direction indicated by the arrow 204 (FIG. 6) will produce hydraulic connections through lines 118 and 170 effecting an opposite movement of the piston 144 by pressurizing chamber 172 and moving the piston rod 146 upwardly in the direction of the arrow 166. The up and down movement of piston 144 causes actuation of the associated power cylinders combined with the boom which is operated in the same manner as before described in connection with operations of the pilot valve 69. Movement of the handle 200 produces a direct displacement of the servo valve 71 entirely independently of the pilot valve 69 in the basket 66.

The operating characteristics of the servo valve 71, as indicated in FIG. 14, likewise has the operating characteristics of feathering or non-linearity in response to initial movements of the spool valve 110 from neutral position so that the basket 66 can be gently and accurately moved or floated into final position. This is possible because of the particular response characteristics effected by a combination of the grooves and cuts in lands 250, 252. Lands 254 and 256 at the extreme ends of the spool as well as lands 250, 252 are grooved as indicated in FIGS. 9, 9*a*. Grooved lands 250, 252 have arcuate cuts 260 in the adjacent confronting surfaces 261 and shallower notches on the remote or oppositely facing edges 265. (FIG. 10). The geometry of these combinations of grooves and cuts together with a relative proportioning therebetween, produces a characteristic performance curve indicated in FIG. 14 in which valve area as a percent of full open is plotted versus the servo valve spool stroke in percent of full stroke. As a result, the characteristics of the servo valve operation is that non-linearity and feathering is achievable at the initial stage of movement of the servo valve by the handle to obtain the feathering characteristic of non linear response, an inflection point of the curve, occurs at about 80 percent of the full stroke, where the valve 71 is in full open, or near full open position, making it possible to greatly increase speed and linearity of basket movement.

Thus, the servo valve 71 in operation has approximately the same operating characteristics as the pilot valve on the basket which is a combination of non-linear feathering type response and control when the operating means is initially applied and there is a need for close and accurate positioning of the basket 66. At the extreme ends of the operating mechanism when either the pilot valve 69 or the servo valve 71 are at or near full open position the basket moves with considerable speed and with a characteristic linearity of response between valve position and basket speed.

The operator, both in the basket and at ground level has then a combination of control of feathering and high speed, both of which characteristics are necessary for quick and accurate response characteristically free of hysteresis.

Referring to FIG. 15, the operating characteristics are summarized in terms of cylinder speed of the servo valve 71 vs. pilot valve 69 stroke. This illustrates the valve characteristics of feathering and non-linearity at initial valve movement from neutral position, such valve movement being related to the operating characteristics affected by slotting the grooved lands of the spool valves 72 and 110.

Referring to FIG. 15, the characteristics of the spool valve slot configuration are such that developing a pressure differential across the spool valves develops a ratio of control pressure output to supply pressure, when expressed as a percentage, varies from 0–100 according to the equation $$\frac{Pc}{Ps} = \frac{100}{1 + \left(\frac{1-\gamma}{\xi\gamma}\right)^2} \quad \text{where } Pc = \text{control pressure},\ Ps = \text{supply pressure}$$

$$\gamma = \frac{\text{stroke of valve}}{\text{full stroke}} \text{ and } 0 \leqq \gamma \leqq 1;$$

$$\xi = \frac{\text{input slot width}}{\text{drain slot width}} \text{ and } 1 \leqq \xi \leqq 3 \text{ where}$$

the slot widths are slots in the lands of the spool valves for altering the hydraulic pressure by small incremental opening of such valves, the whole operating to impart a non-linear response to movement of the controls such that a relatively large initial increment of control movement is necessary to obtain a relatively small initial increment of velocity of the basket with an increasingly large basket velocity obtained by later incremental control movement, the whole forming a system giving a total response which is highly responsive to operator control.

While the present invention has been illustrated and described in connection with a few selected example embodiments, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims as equivalents of the invention.

I claim:

1. A mobile articulated tower comprising a combination lower and upper boom having an articulated connection therebetween, a work basket at the free end of the upper boom, means forming a base pivotal mounting for the lower boom, means forming a base pivotal mounting for the lower boom, a first power actuating means for effecting pivoting of said upper boom about the lower boom, a second power actuating means for effecting arcuate movement of the lower boom about its base pivotal mounting and a third power actuating means for effecting angular movement of both said booms about the base pivotal mounting therefor, closed center hydraulically operated and operator controlled actuator means, one for each of said first, second and third power actuating means and each including a pilot valve and a servo valve, each of said pilot valve and servo valve including a spool valve with grooved lands and axial slots which impart operating characteristics of fluid flow whereby operation of either the pilot valve or the servo valve will effect non-linear response of the actuator means associated with each of the three movements of the boom during initial movements from neutral positions of said pilot and servo valves respectively, and effecting linear high speed response at the full open positions of said pilot valve and servo valve respectively.

2. The apparatus in accordance with claim 1 including spring means for biasing each such spool valve to a neutral position in which the hydraulic system is closed.

3. The apparatus in accordance with claim 1 in which the spool valve forming a part of the servo valve includes four spaced lands, each having a plurality of circumferential grooves therein, and notches in the confronting surfaces of the central two of said lands and configured to provide a substantial increase in valve area as a function of spool movement in accordance with movement of the spool valve from neutral position.

4. The apparatus in accordance with claim 1 in which the first, second, and third power actuator means for producing the three directional movements of said basket are operatable by separate and independent operation of pilot spool valve and servo spool valve associated one with each of said first, second, and third actuator means.

5. The apparatus in accordance with claim 4 including means for providing a constant fluid pressure supply to the spool valve of said pilot valve, and means for communicating the fluid pressure of said pilot valve selectively to one or the other of opposite ends of said servo spool valve responsively to displacement of said pilot valve to effect servo valve displacement in either of opposite directions and thereby to communicate fluid pressure from a source of supply to the power actuator associated with basket movement in one or a combination of its three modes of movement.

6. The apparatus in accordance with claim 5 in which the lands of the respective spool valves are configured with notches to provide communication of fluid pressure as a function of spool valve position whereby the response effected by spool valve movement is non-linear in the initial stages of spool movement from neutral position and then linear at the terminal portions of valve movement.

7. A process for controlling movement of a basket in a mobile articulated boom system comprising the steps of selectively communicating pressure to any one or a combination of independently operated first, second, and third power actuating means for effecting composite vertical, horizontal and lateral movements of a basket, controlling the amount of fluid pressure communicated by a closed center hydraulically operated operator-controlled actuator means whereby the communicated fluid pressure to said power actuating means is non-linear at the initial stages of operator movement, and communicating from ground level a selectively controllable second input of fluid pressure to said first, second and third actuator means through a valve having non-linear control characteristic of hydraulic pressure communicated in response to valve movement during initial stages of such valve operation.

8. The process in accordance with claim 7 in which said operator-controlled actuator means effects non-linear feathered output in proximity to the neutral position and successively becomes more linear in response to its extreme displacements.

9. The process in accordance with claim 7 in which the ratio of control pressure to supply pressure expressed as a percentage varies from 0–100 according to the equation:

$$\frac{Pc}{Ps} = \frac{100}{1 + \left(\frac{1-\gamma}{\xi\gamma}\right)^2} \quad \text{where } Pc = \text{control pressure},\ Ps = \text{supply pressure}$$

$$\gamma = \frac{\text{stroke of valve}}{\text{full stroke}} \text{ and } 0 \leqq \gamma \leqq 1;$$

$$\xi = \frac{\text{input slot width}}{\text{drain slot width}} \text{ and } 1 \leqq \xi \leqq 3 \text{ where the slot}$$

widths are slots in the lands of the spool valves.

10. The process of controlling movement of a basket in a hydraulically operated articulated tower construction comprising the steps of:

applying hydraulic pressure to three spool type valves: one controlling a hydraulic motor rotating the tower on its base, one controlling a hydraulic cylinder actuating the lower boom by pivotal movement in a vertical plane containing the base, and one controlling a hydraulic cylinder actuating the upper boom pivoted on the lower boom and movable in a vertical plane containing the lower boom;

developing a pressure differential across the spool type valves such that the ratio of control pressure output to supply pressure expressed as a percentage varies from 0–100 according to the equation $$\frac{Pc}{Ps} = \frac{100}{1 + \left(\frac{1-\gamma}{\xi\gamma}\right)^2} \quad \text{where } Pc = \text{control pressure},\ Ps = \text{supply pressure}$$

$$\gamma = \frac{\text{stroke of valve}}{\text{full stroke}} \text{ and } 0 \geqq \gamma \geqq 1;$$

$$\xi = \frac{\text{input slot width}}{\text{drain slot width}} \text{ and } 1 \geqq \xi \geqq 3, \text{ where the slot widths}$$

are slots in the lands of the spool valves for altering the hydraulic pressure by small incremental opening of such valves, to impart a non-linear response to movement of the controls whereby a relatively large initial increment of control movement is necessary to obtain a relatively small initial increment of velocity of the basket and an increasingly large basket movement obtained by later incremental control movement, the whole forming a system giving a total response which is highly responsive to operator control.

* * * * *